US008056289B1

(12) United States Patent
Konstantin

(10) Patent No.: US 8,056,289 B1
(45) Date of Patent: Nov. 15, 2011

(54) DUAL GLAZING PANEL SYSTEM

(75) Inventor: Moshe Konstantin, Highland Park, IL (US)

(73) Assignee: Konvin Associates Ltd., Lake Forest, IL (US)

( * ) Notice: Subject to any disclaimer, the term of this patent is extended or adjusted under 35 U.S.C. 154(b) by 244 days.

(21) Appl. No.: 12/426,129

(22) Filed: Apr. 17, 2009

Related U.S. Application Data

(60) Provisional application No. 61/045,818, filed on Apr. 17, 2008.

(51) Int. Cl.
*E06B 7/14* (2006.01)
*E06B 3/988* (2006.01)

(52) U.S. Cl. ..... 52/204.591; 52/302.3; 52/745.16; 52/582.1

(58) Field of Classification Search ..... 52/204.591, 52/204.593, 204.71, 204.72, 209, 302.3, 52/745.08, 745.16, 204.595, 204.597, 204.6, 52/204.62, 588.1, 582.1, 549
See application file for complete search history.

(56) References Cited

U.S. PATENT DOCUMENTS 3,734,550 A * 5/1973 Vance ..... 403/34
4,332,119 A * 6/1982 Toews ..... 52/481.2
4,407,105 A * 10/1983 Frank ..... 52/204.591
4,768,319 A * 9/1988 Derner ..... 52/208
4,998,395 A * 3/1991 Bezner ..... 52/563
5,348,790 A * 9/1994 Ben-Zvi et al. ..... 428/178
5,423,157 A * 6/1995 Watanabe ..... 52/745.08
5,491,943 A * 2/1996 Vondrejs et al. ..... 52/239
5,584,155 A * 12/1996 Watanabe ..... 52/538
5,592,795 A * 1/1997 Rinehart et al. ..... 52/235
5,622,017 A * 4/1997 Lynn et al. ..... 52/209
5,647,184 A * 7/1997 Davis ..... 52/592.1
5,678,383 A * 10/1997 Danielewicz ..... 52/775
5,845,446 A * 12/1998 Funaki et al. ..... 52/461
5,901,528 A * 5/1999 Richardson ..... 52/783.1
5,966,888 A * 10/1999 Richardson ..... 52/580
6,016,632 A * 1/2000 McGee et al. ..... 52/241
6,101,777 A * 8/2000 Bodine et al. ..... 52/506.06
RE36,976 E * 12/2000 Bezner ..... 52/563
6,164,024 A 12/2000 Konstantin
6,202,382 B1 * 3/2001 Conterno ..... 52/762
6,298,627 B1 * 10/2001 Richardson ..... 52/582.1
6,536,175 B2 * 3/2003 Conterno ..... 52/489.1
6,662,512 B2 * 12/2003 Westphal ..... 52/204.5
6,711,870 B1 * 3/2004 Richardson ..... 52/775
6,845,592 B2 * 1/2005 Voegele ..... 52/466
7,281,353 B2 * 10/2007 Konstantin ..... 49/82.1
7,313,893 B2 * 1/2008 Voegele, Jr. ..... 52/461
7,441,379 B2 * 10/2008 Konstantin ..... 52/200
7,546,708 B2 * 6/2009 Konstantin ..... 52/200
7,562,504 B2 * 7/2009 Herbst et al. ..... 52/461
7,578,104 B2 * 8/2009 Rinehart et al. ..... 52/204.593
7,594,364 B2 * 9/2009 Rinehart et al. ..... 52/204.593
7,621,084 B2 * 11/2009 Bilge ..... 52/235
7,748,186 B2 * 7/2010 Voegele, Jr. ..... 52/466
7,765,760 B2 * 8/2010 Konstantin ..... 52/466

(Continued)

*Primary Examiner* — Brian Glessner
*Assistant Examiner* — Rodney Mintz
(74) *Attorney, Agent, or Firm* — Drinker Biddle & Reath LLP

(57) ABSTRACT

A transparent or translucent modular upstanding seam flange panel unit comprising opposed seam flange panels mounted in metal male and female locking engagement members designed to interlock and provide an internal gutter for collecting infiltrating water and for accommodating lateral expansion and contraction of the panels as well as a method for erecting an architectural structure for passing sunlight into an interior region of a building using such panel units.

23 Claims, 8 Drawing Sheets

U.S. PATENT DOCUMENTS

| | | | | |
|---|---|---|---|---|
| 7,823,346 | B2 * | 11/2010 | Lang | 52/235 |
| 7,823,833 | B2 * | 11/2010 | Wood | 244/129.3 |
| 7,866,111 | B2 * | 1/2011 | Johansson | 52/588.1 |
| 7,926,236 | B2 * | 4/2011 | Konstantin | 52/466 |
| 2003/0205009 | A1 * | 11/2003 | Herbst et al. | 52/235 |
| 2003/0213202 | A1 * | 11/2003 | Hutchings et al. | 52/578 |
| 2004/0020150 | A1 * | 2/2004 | Fensel et al. | 52/468 |
| 2004/0221526 | A1 * | 11/2004 | Rinehart et al. | 52/204.62 |
| 2004/0256000 | A1 * | 12/2004 | Konstantin | 136/251 |
| 2004/0261336 | A1 * | 12/2004 | Konstantin | 52/200 |
| 2006/0096224 | A1 * | 5/2006 | Asbury | 52/582.1 |
| 2006/0185273 | A1 * | 8/2006 | Lathief | 52/204.71 |
| 2008/0016800 | A1 * | 1/2008 | Tufts et al. | 52/204.6 |
| 2008/0202055 | A1 * | 8/2008 | Boda | 52/582.1 |
| 2009/0049770 | A1 * | 2/2009 | Konstantin | 52/200 |
| 2009/0113826 | A1 * | 5/2009 | Abdul Lathief | 52/214 |
| 2009/0293241 | A1 * | 12/2009 | Voegele, Jr. | 24/457 |
| 2010/0126099 | A1 * | 5/2010 | Ben-Zvi | 52/582.1 |
| 2010/0132293 | A1 * | 6/2010 | Voegele et al. | 52/402 |
| 2010/0212238 | A1 * | 8/2010 | Voegele et al. | 52/204.595 |
| 2010/0242397 | A1 * | 9/2010 | Givoni et al. | 52/588.1 |
| 2010/0287858 | A1 * | 11/2010 | Israeli et al. | 52/220.7 |
| 2011/0138727 | A1 * | 6/2011 | Labrecque | 52/483.1 |
| 2011/0179735 | A1 * | 7/2011 | Paetrow et al. | 52/309.1 |
| 2011/0179739 | A1 * | 7/2011 | Konstantin | 52/582.1 |
| 2011/0185667 | A1 * | 8/2011 | Carter | 52/506.05 |
| 2011/0197535 | A1 * | 8/2011 | Baker et al. | 52/588.1 |

* cited by examiner

DUAL GLAZING PANEL SYSTEM

CROSS-REFERENCE TO RELATED PATENT APPLICATION

This patent application claims the benefit of U.S. Provisional Patent Application No. 61/045,818, filed Apr. 17, 2008.

FIELD OF THE INVENTION

This invention pertains to modular upstanding seam flange glazing panels for architectural structures and, more particularly, to systems for assembling such modular upstanding seam flange panels into unique paired glazing panel units and for installing the units in sloped glazing, skylights, roofs, walls, and other architectural structures in ways not heretofore imagined.

BACKGROUND OF THE INVENTION

Extruded modular panels with upstanding seam flanges made of polycarbonate and other resins are widely used in the design of various architectural structures because they are a strong, lightweight alternative to traditional materials, like glass, which they often replace. For example, such modular glazing panels joined along abutting upstanding seam flanges that extend along their edges can be used either alone or with a supporting framework of, e.g., purlins or rafters, to form overhead or roofing structures. The ability of such panels to transmit light has made them particularly useful where it is desired to allow sunlight to pass into a structure such as to illuminate the interior region of a building. An additional advantage of these panels is that they have good energy conservation and sound insulation characteristics. Indeed, it has been found that when such glazing panels are paired one over the other into a unit with an enclosed airspace between the panel pair, improved energy conservation and sound insulation properties can be achieved. Paired extruded modular panels also have greater structural strength making them useful in applications where single panel units could not be used or would require additional supporting elements.

Each modular upstanding seam flange glazing panel is typically up to 40 feet in length, 2-4 feet wide and flexible. It therefore requires substantial skill and is time-consuming to assemble and install panel pairs on-site. The challenge to assembling and installing the panel pairs faced by such skilled workers can be appreciated, for example, by examining FIG. 1 which illustrates a current representative panel pair assembly system. More particularly, FIG. 1 shows a purlin 1 and one of a series of myriad metal retaining clips 2 affixed along the purlin. The retaining clips include horizontal flanges 3. Once the series of spaced retaining clips are in place on the purlin (or other supporting member), polycarbonate (or other resin) bottom modular panels 4A and 4B are manipulated into position and slid horizontally under the flanges of the retaining clips. Then, an elongated resilient batten joint connector 5 with a downwardly facing elongated bottom cavity 6A is forced down over the upstanding seam flanges 7A and 7B of modular panels 4A and 4B to lock them onto the retaining clips by way of sawteeth in the bottom cavity that mate with sawteeth on the flanges of the bottom panels. Finally, top modular panels 8A and 8B are manipulated into position with their seam flanges 9A and 9B aligned with the upwardly facing elongated top cavity 6B in the batten joining connector and pressed into place with the sawteeth of flanges 9A and 9B of modular panels 8A and 8B held in place by corresponding sawteeth within cavity 6B.

While there are many typically inferior variations on the paired modular panel unit system of FIG. 1, it is indicative of the relative complexity of assembling and installing sloped glazing, skylights, roofs, walls and other architectural structures having paired modular panel units on-site. The system of FIG. 1 also illustrates the conventional metal (retaining clip) to polycarbonate skin (flange of panel) contact employed in current modular upstanding seam panel retention systems. Because those skilled in this art have been wed to fixing the panels in place through such direct engagement of an unforgiving hard or high ultimate tensile strength metal retention clip against the resilient low ultimate tensile strength skin of the polycarbonate modular panel, it has been necessary to take extra steps to ensure that load specifications are met. For example, skin weight of the panel flanges is greater than it otherwise would need to be in order to prevent cracking of the polycarbonate skin of the flanges under load. This excess weight results in unnecessary material usage/cost and less than optimal light transmission. Also, large numbers of closely spaced retention clips are often required to meet wind load and other load specifications by spreading out the load across more clips also to prevent cracking of the polycarbonate skin of the flanges under load.

There is therefore a great need for a system that makes it easier and less time-consuming to assemble and install or erect paired modular panel units. If such a system also provided a completed architectural glazing structure comprised of modular upstanding seam flange panels which is safe, secure, surprisingly strong and able to withstand substantially increased wind loads, a particularly unexpected and useful contribution to the art would be at hand. If such a system further eliminated the inherent limitations of conventional metal-to-polycarbonate engagement, required fewer retention clips, and made it possible to reduce panel flange skin thickness an extremely important and unexpected advance in the art would be in the offing.

The present invention provides such a system for readily assembling together pairs of such modular glazing panels either on-site (but in convenient ground level work areas) or off-site and then readily installing the pre-assembled modular panel units on-site to erect the sloped glazing, skylights, roofs, walls, and other architectural structures. This new system is particularly elegant in that it armors the standing seams of the modular panels to thereby provide a unique new metal-to-metal retention that withstands increased wind and snow loads while making it possible to reduce the weight of the polycarbonate skin of the flanges and optionally to use bottom or inner panels with lighter skins across the entire panel. It is also surprisingly economical in terms of materials (e.g., reduced number of retention clips and thinner polycarbonate skins) and in terms of construction costs since it can be erected quickly and generally without special skills, and produces architectural structures that can accommodate wider spans, are surprisingly effective in limiting air, water and sound infiltration, and have outstanding energy conservation characteristics. Indeed, the present system makes it possible to readily insert infill into the airspace between the panels off-site (or on-site) in the form of translucent insulation (e.g., glass fiber), or to add metal screening for improving the fire resistance of the panel unit and for resisting severe localized impacts on the outer panel. It is extremely difficult and expensive to add infill to prior art panel units which must be assembled on-site.

Finally, it is important to accommodate horizontal expansion and contraction of the modular panels. While prior systems for assembling and installing panel pairs have a limited ability to accommodate such expansion and contraction, the use of the interlocking male and female locking engagement members of the present invention accommodates such horizontal expansion and contraction far better than any earlier design and in a way not remotely contemplated by those skilled in this art.

SUMMARY

In one embodiment, the present invention comprises a modular upstanding seam flange panel unit. The unit has opposed transparent or translucent elongated top and bottom upstanding seam flange panels with corresponding elongated upwardly and downwardly directed flanges and an airspace disposed between the panels. The seam flanges are disposed at opposite lateral edges of the panels. Finally, interlocking metal male and female locking engagement members are provided each having upwardly and downwardly disposed cavities attached respectively to the corresponding upwardly and downwardly directed flanges of the panels. The panel flanges each have sawteeth and the cavities of the interlocking metal male and female locking engagement members have corresponding sawteeth that engage the panel flanges.

When two panel units are interlocked, the metal male and female locking engagement members of the two adjoining laterally disposed panel units form an internal gutter for collecting any water that infiltrates past the opposed lateral edges of the top modular panels of adjoining modular panels. The bottom of the internal gutter is defined by a guide member that projects from the male locking engagement member in cooperation with a walled cavity in the female locking engagement member that receives the guide member. Also, preferably the walled cavity in the female member includes a resilient member disposed to sealingly engage the guide member when the male and female locking engagement members are interlocked.

In another preferred embodiment, the male locking engagement member includes a guide member having a generally downwardly directed nub and the female locking engagement member includes a walled cavity for receiving the guide member with a corresponding generally upwardly directed nub on a wall of the cavity. The upwardly directed nub on the wall of the cavity is positioned to engage the nub on the guide member as the male and female locking engagement members are moved into interlocking position.

In another embodiment the invention comprises an architectural structure for passing sunlight into an interior region of a building having supporting structure while limiting the infiltration of water, air and sound. At least two transparent or translucent modular panel units are provided having opposed elongated top and bottom modular panels with corresponding elongated upwardly and downwardly directed flanges and an airspace disposed between the panels. The seam flanges are disposed on opposite lateral edges of the panels. Interlocking metal male and female locking engagement members are disposed respectively at the opposite lateral edges of the panels, with each of the locking engagement members having upwardly and downwardly disposed cavities attached respectively to the corresponding upwardly and downwardly directed flanges.

The panel skins have substantially lower ultimate tensile strength than the ultimate tensile strength of the interlocking metal male and female locking engagement members. Finally, a second panel unit a having a locking engagement member is disposed opposite the corresponding locking engagement member of a second one of the units and interlocked therewith. Preferably at least one of the corresponding locking engagement members is affixed to a supporting structure by metal retaining clips.

In a preferred embodiment the modular panels of the architectural structure include resilient areas along their lateral edges. These resilient areas accommodate lateral expansion and contraction of the modular panels in conjunction with the interlocking locking engagement members to help control air, water and sound infiltration when the panel units are interlocked and to avoid buckling of the panels as a result of lateral panel expansion.

In another embodiment the invention comprises a method of erecting an architectural structure for passing sunlight into an interior region of a building having supporting structure while limiting the infiltration of water, air and sound. The method includes assembling at least two transparent or translucent modular upstanding seam flange panel units having opposed elongated top and bottom modular panels with corresponding elongated upwardly and downwardly directed flanges and an airspace disposed between the panels. The seam flanges are disposed at or near opposite lateral edges of the panels, with interlocking metal male and female locking engagement members each having upwardly and downwardly disposed cavities attached respectively to the corresponding upwardly and downwardly directed flanges at the opposite lateral edges of the modular panels. Finally, the corresponding male and female locking engagement members are interconnected to complete the architectural structure. In a preferred embodiment, at least one of the corresponding male and female locking engagement members is affixed to the supporting structure.

BRIEF DESCRIPTION OF THE DRAWINGS

In order to aid in understanding the invention, it will now be described in connection with exemplary embodiments thereof with reference to the accompanying drawings in which like numerical designations will be given to like features with reference to the accompanying drawings wherein.

DETAILED DESCRIPTION OF PREFERRED EMBODIMENTS

Figure 1:
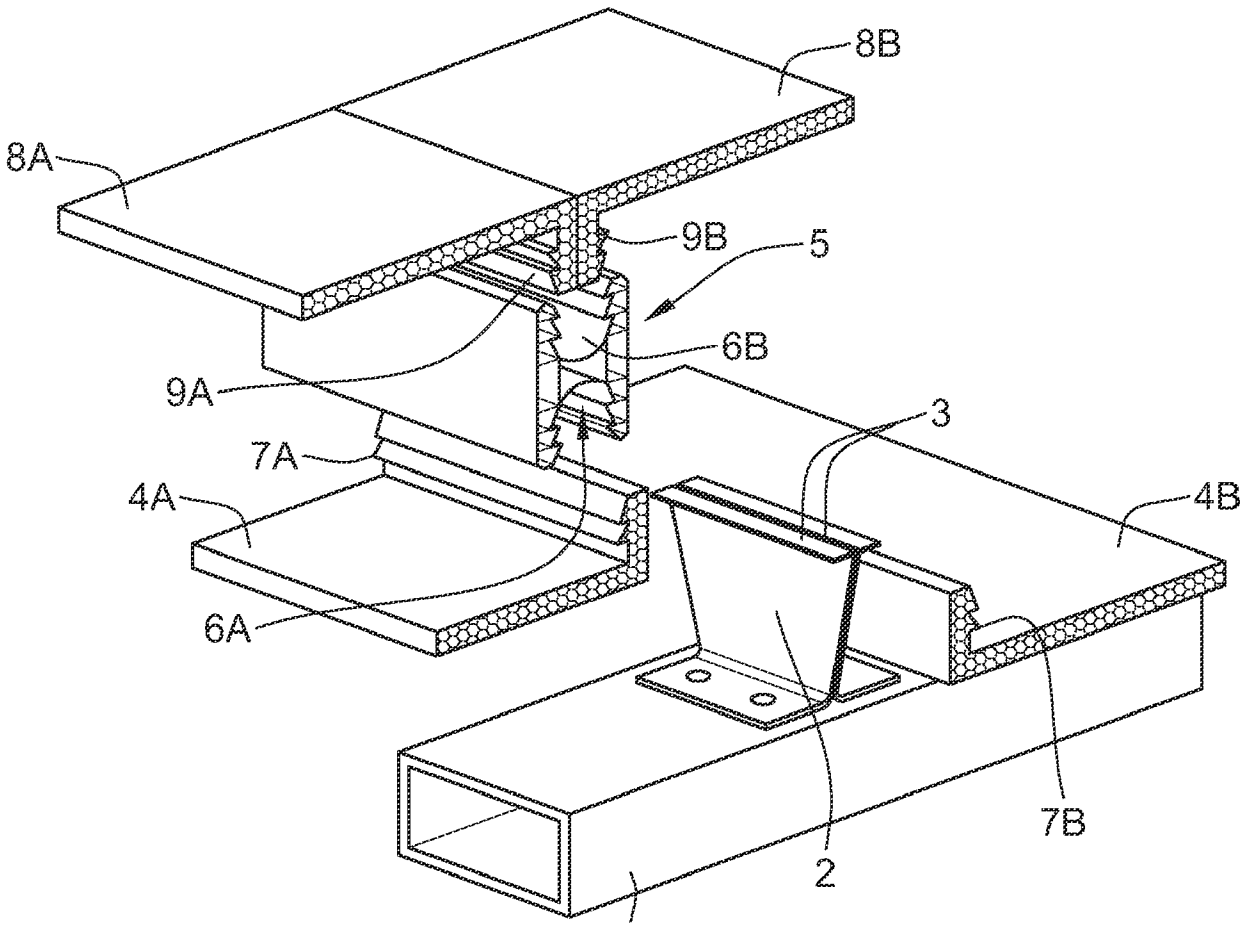
FIG. 1 (PRIOR ART)
FIG. 1 is a partial exploded perspective view of a prior art modular panel pair assembly and installation system.
Figure 2:
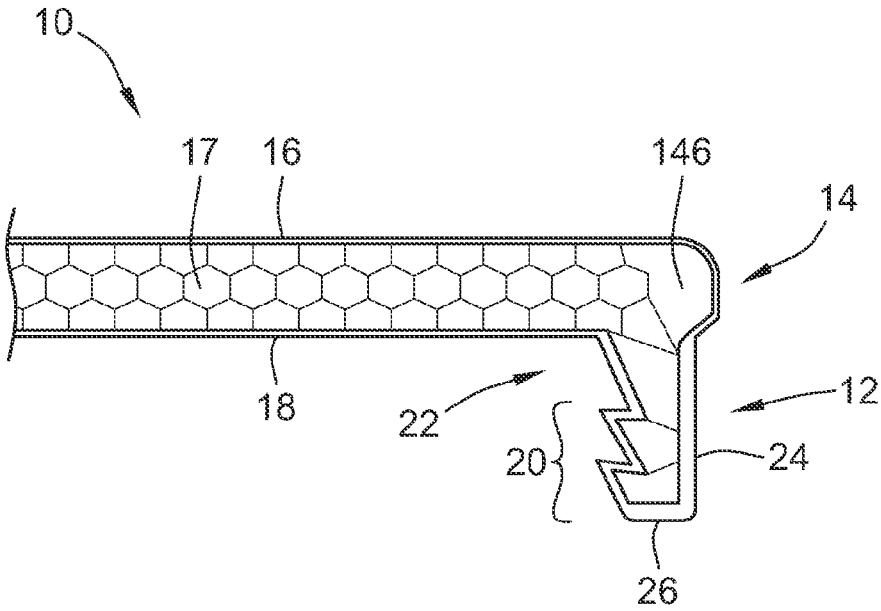
FIG. 2 is a sectional view of a portion of a modular upstanding seam flange panel that may be used in the practice of this invention.

Turning now to FIG. 2, a single modular upstanding seam flange panel 10 is shown in cross-section, with a seam flange 12 at its distal end 14. The seam flange extends along the entire length or lateral edge of the panel which may be, for example, up to 40 feet in length and from 2 to 4 feet in width. A second flange will be located along the opposite edge of the modular panel parallel to flange 12. Of course, the panels may be provided in other sizes if desired.

Modular panel 10 may be extruded from polycarbonate (or other resin) and may have a plurality of internal cells in a honeycomb configuration 17 (or other configuration) disposed in the interior of the panel between its outer surface 16 and its inner surface 18. Modular panels 10 with this upstanding seam flange design are known in the art and described for example in U.S. Pat. No. 6,164,024, which is incorporated by reference for purposes of describing the panels and installations in which they may be used. Modular panels with upstanding seam flanges of the design shown in FIG. 2 and modified versions thereof that function generally in the same fashion, made of polycarbonate or other resins, will be referred to herein as "modular panels," "modular upstanding seam flange panels," etc.

The preferred honeycomb cell configuration 17 of modular glazing panels 10 helps control the panel thermal expansion in all directions and gives it resistance to impact and wind and snow loading while maintaining superior light-difusion capabilities. Particularly desirable modular panels 10 are available from CPI Daylighting, Inc., 28662 Ballard Drive, Lake Forest, Ill. 60045 as PENTAGLAS®NANO-CELL® architectural panels.

Upstanding seam flanges 12 have a series of sawteeth 20 along their inner surface 22 and will generally be flat along their outer surface 24 optionally with the protruding open bubble corner area 146 discussed below. The surface 26 of the flanges (at the top or bottom of the flanges depending on how it is oriented in the panel unit) may also be flat. Additionally, it should be noted that preferably the flanges also include internal cells to give them enhanced strength, resilience, and expansion/contraction properties. Other modular panel designs appear in FIGS. 6, 7 and 8 and will be addressed below. In all cases the modular panels have a thin low ultimate tensile strength skin.

Figure 3A:
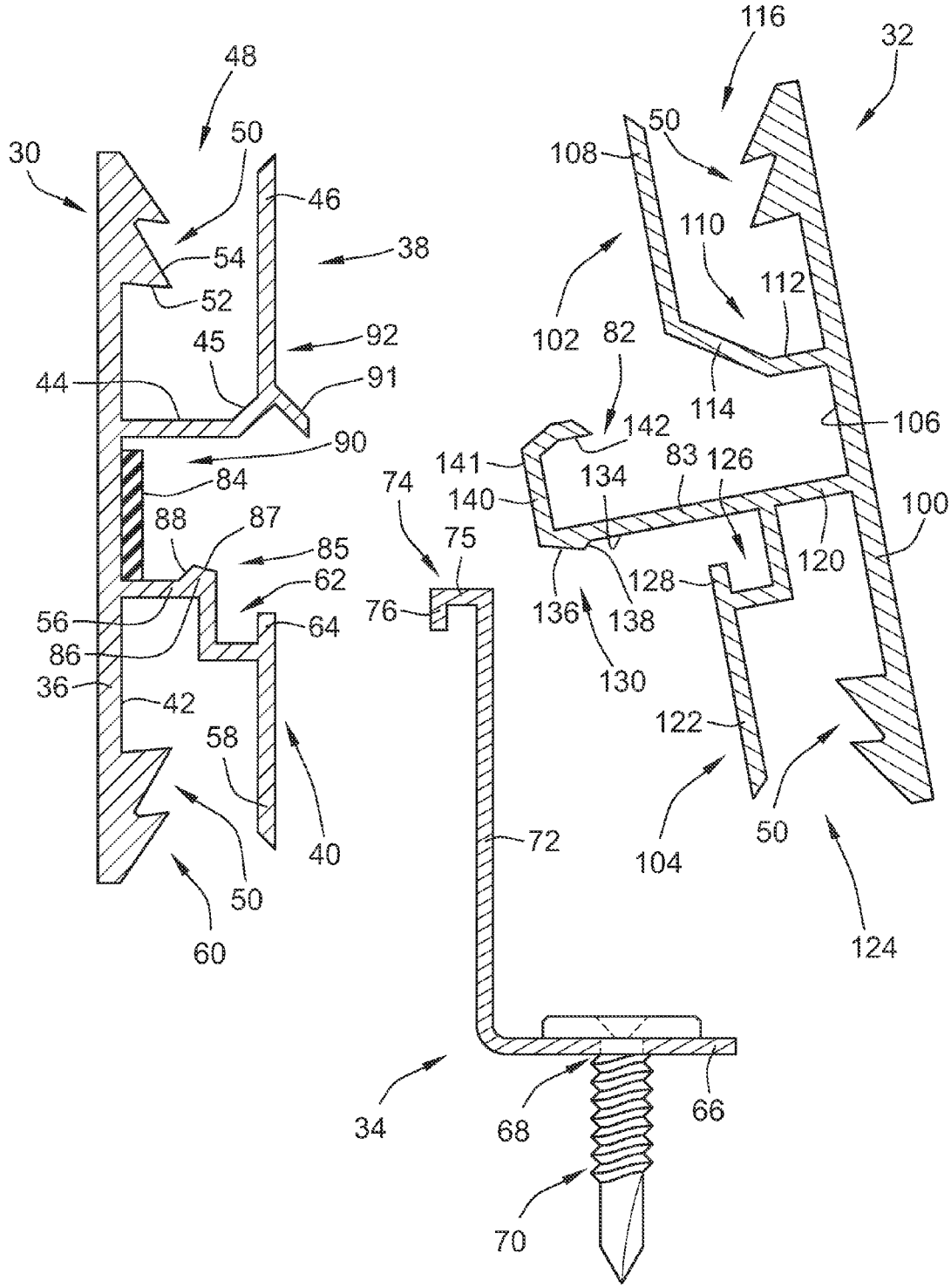
FIGS. 3A and 3B are elevation views taken respectively at ends of male and female locking engagement members of an embodiment of the invention before and after interconnection.
Figure 3B:
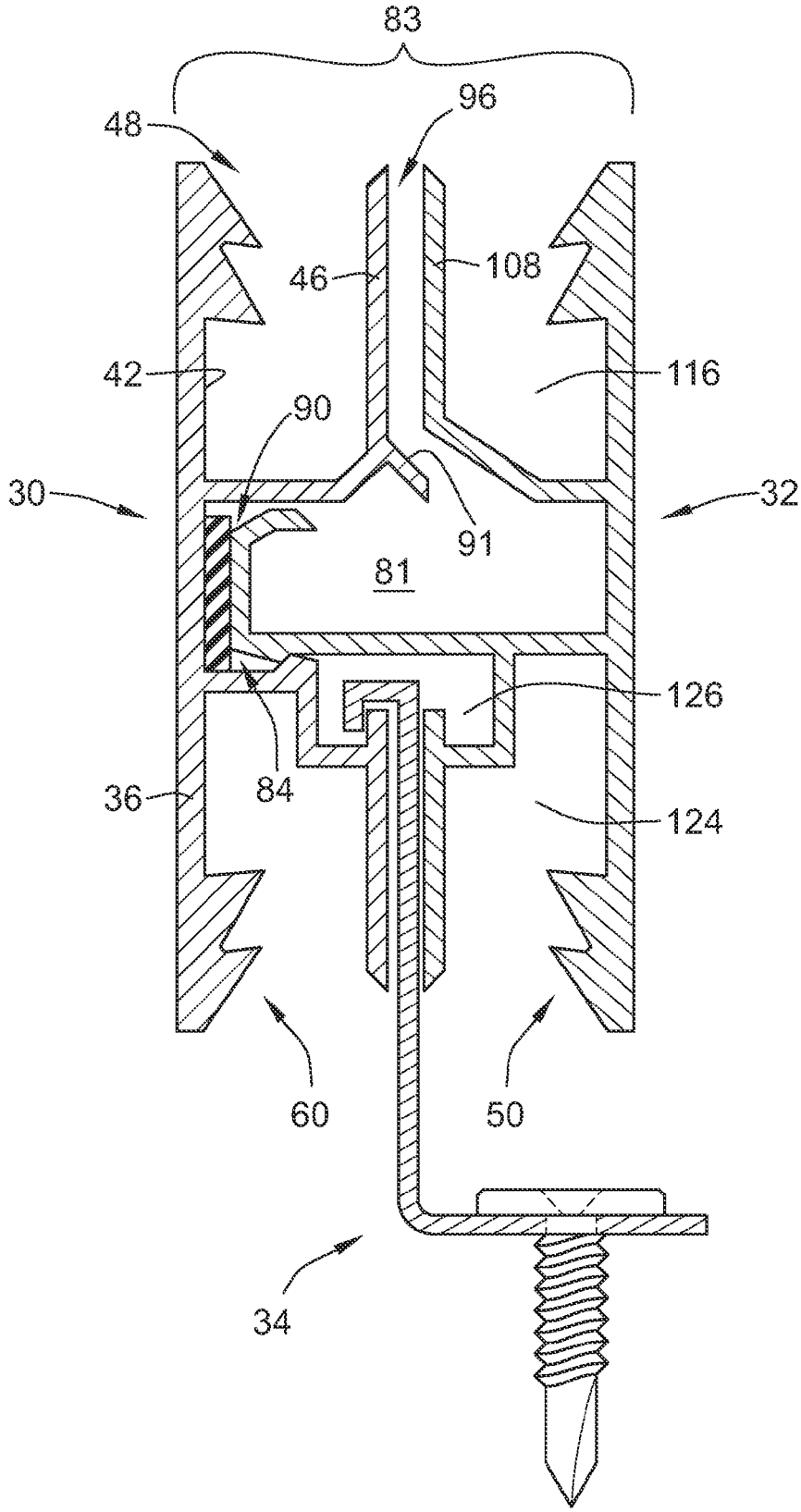

In accordance with one embodiment of the invention, FIG. 3A shows a metal female locking engagement member 30 and its corresponding metal male locking engagement member 32 with a metal retention clip 34 juxtaposed between the two. Members 30 and 32 are designed to interlock as illustrated in FIG. 3B. Both locking engagement members may be made, for example, as aluminum extrusions and are each configured for attachment to upstanding seam flanges 12 of corresponding pairs of panels to construct a panel unit while armoring the standing seam flange to thereby provide a panel surface for metal-to-metal engagement with retention clip 34. The metal construction of the clips means that they have high ultimate tensile strength.

The armoring of the skin of the flanges by the metal of the locking engagement members protects the flanges (and panels) from damage at the points of contact by the retention clip and elsewhere that might otherwise occur due to wind or snow loads. It also makes the entire panel unit substantially stronger making it possible to reduce the weight of the skin of the panel flanges and to use the panel unit across spans and in other applications in which conventional panel units could not be used without additional retention clips and structural support. Indeed, unlike conventional systems where the bearing load is sustained primarily by the bottom or inner panel, in the present invention the load is sustained primarily by the male and female locking engagement members and the top or outer panel so an overall lighter skinned inner panel can be used.

Figure 4B:
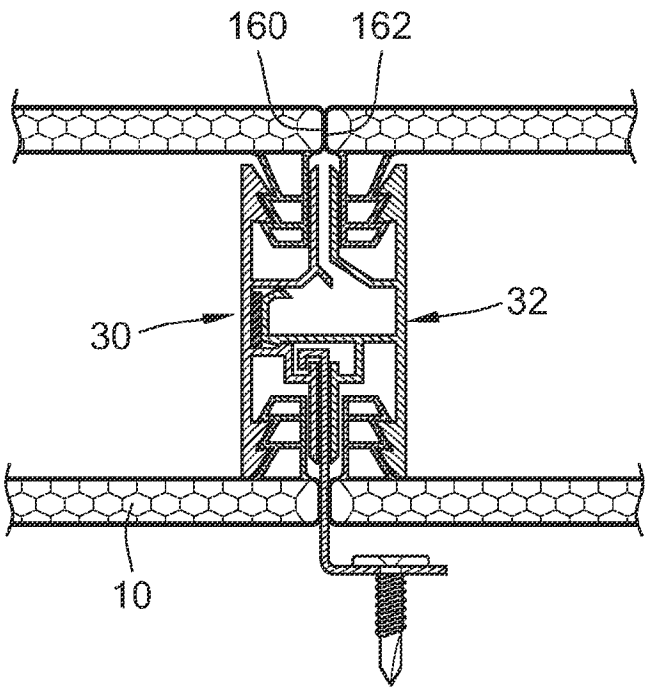
FIGS. 4A and 4B respectively correspond with FIGS. 3A and 3B but modular panels are shown installed in the male and female locking engagement members of adjoining panel units.

In FIG. 3A, female locking engagement member 30 is disposed vertically (as it would be, e.g., at rest in a horizontal roof or skylight installation) and male locking engagement member 32 is angled with respect to the female locking engagement member to correspond to the orientation of the locking engagement members during the course of final on-site or erection process which concludes with the panel units installed in the juxtaposed arrangement of, e.g., FIG. 4B. Alternatively, the panel units may be installed by aligning them vertically and sliding them together until the locking engagement members interlock.

Figure 4A:
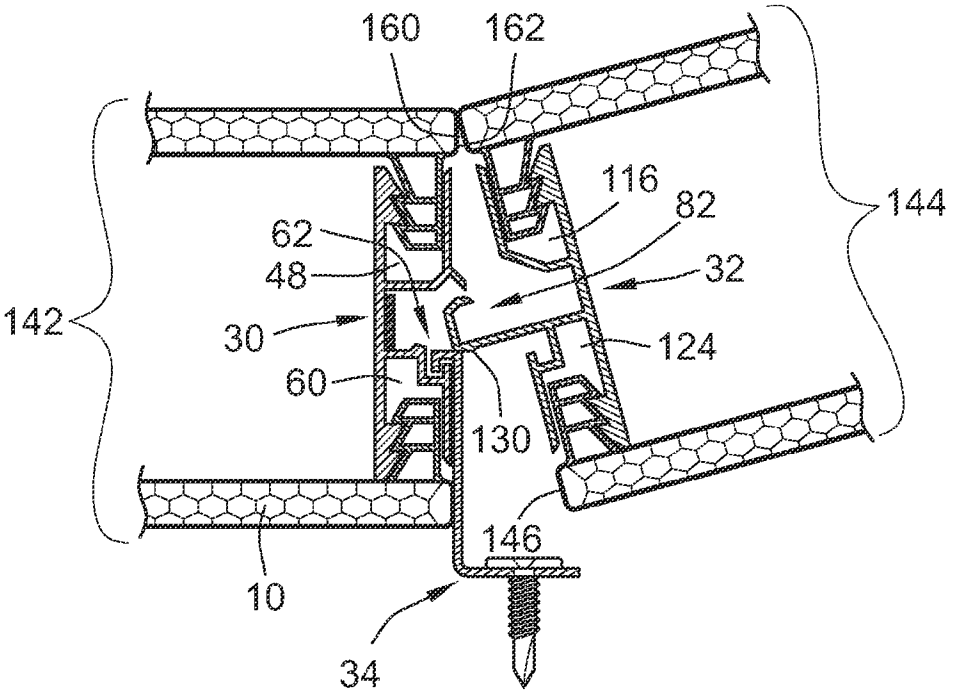

Female locking engagement member 30 includes a base 36 which is oriented vertically in the figure and generally U-shaped upwardly and downwardly directed arms 38 and 40 which depend from the back surface 42 of the base. Arm 38 includes a generally flat horizontal portion 44 and a generally flat vertical portion 46. Horizontal portion 44 includes an optional angled outer corner portion 45 to enhance the resilience and resistance to breakage of arm 38 at this corner. The back surface of the base and the U-shaped arm together define an upwardly directed cavity 48 for receiving the flange of the top modular panel of panel unit 142 as illustrated in FIGS. 4A and 4B. Finally, at least one sawtooth and preferably at least two sawteeth 50 (as shown) project from back surface 42 into cavity 48 to engage sawteeth 20 on upstanding flange 12 of panel 10 in the assembly of the modular panel unit on locking engagement member 38. Sawteeth 50 include horizontal portions 52 and angled portions 54 which are angled and dimensioned to engage sawteeth 20 of the panel flange.

In a like manner, downwardly directed U-shaped arm 40 includes a generally horizontal portion 56 and a vertical portion 58. The horizontal and vertical portions define a downwardly directed cavity 60 which will engage the upstanding flange of a second panel of the modular panel unit assembled on locking engagement member 38. Horizontal portion 56 may be stepped downwardly, as shown, to produce a slot 62 having an upwardly directed lip 64 for receiving engagement hook 74 of retention clip 34 and achieving a metal-to-metal retention of the panel unit flange. Other alternative structural arrangements for engagement between the retention clip and the locking engagement member may, of course, be used so long as metal-to-metal engagement is ensured.

Retention clip 34 includes a base 66 with a hole 68 for receiving a fastener 70 which will be driven or screwed into a purlin, rafter or other support (not shown) to hold adjoining juxtaposed modular panel units (e.g., units 142 and 144 of FIG. 4B) in place. Base 66 supports an upstanding wall 72 and an engagement hook 74. The hook includes a ledge 75 and a downwardly directed lip 76 dimensioned to fit within slot 62 and engage the inner surface of locking engagement member lip 64 to retain female locking engagement member 30 and (after it is interlocked with the corresponding female locking engagement member) adjoining male locking engagement member 32 in place during the on-site erection of the desired sloped glazing, skylights, roofs, walls, and other architectural structures from series of juxtaposed panel units. As noted elsewhere, however, in short span applications the panel units may be interconnected and erected in place without the use of retention clips.

Horizontal portions 44 and 56 of upwardly and downwardly directed arms 38 and 40 are spaced from each other to define or wall in a horizontally directed inner cavity 80. Inner cavity 80 receives a guide member 82 of male locking engagement member 32 and in doing so helps form an inner gutter 81 (FIG. 3B) in the final interconnected locking engagement member pair 83, which will be discussed in more detail below. The guide member is responsible for resisting loads on the interconnected locking engagement members and so must be strong and long enough to accommodate the maximum expected load on the interconnected locking engagement members.

Preferably a resilient sealing strip 84 will be positioned in cavity 80 along the back surface 42 of base 36 in horizontally directed inner cavity 80 to engage guide member 82 establishing a gutter seal 90 to help achieve and maintain a water- and air-tight condition in inner gutter 81 while also enhancing the soundproofing properties of the final interconnected locking engagement member pair 83 as illustrated in (FIG. 3B) Inner gutter 81 in turn carries the water to an open end of the interconnected locking engagement members where a still and appropriate flashing will be provided to collect escaping water and to carry it away from the slopped glazing, skylight, roof, wall or other architectural structure.

Also, top corner 85 of step portion 62 preferably will have a nub 86 with front and back inclined surfaces 87 and 88 which facilitate the interlocking process as will be described below. Finally, an optional water rail 90 projects away from the outer surface 92 of vertical portion 46. As will be discussed further below, this rail directs any water that infiltrates or is drawn down between the adjacent top panels of juxtaposed panel units and will move down surface 92 due to surface tension effects or through the gap 96 between vertical portions 46 and 108 away from gutter seal 91 to minimize the likelihood that the water will find its way to the gutter seal.

Turning now to male locking engagement member 32 in FIG. 3A, it is seen that this locking engagement member has a base 100 and U-shaped upwardly and downwardly directed arms 102 and 104 which depend from the back surface 106 of the base. Arm 102 includes a generally flat vertical portion 108, and a bottom 110 made up of a first flat portion 112 generally perpendicular to base 100 and second upwardly angled flat portion 114. This bottom configuration is chosen to enhance the resilience and resistance to breakage like the corner on arm 38 described above and is, of course, optional. Back surface 106 of base 100 and U-shaped arm 102 together define a generally upwardly directed cavity 116 for receiving the downwardly directed flange of the top modular glazing panel of the panel unit, as will be described below. Finally, sawteeth 50 project from back surface 106 into cavity 116 to engage sawteeth 20 on upstanding flange 12 of a modular panel 10. Sawteeth 50 include horizontal and angled portions that are dimensioned to engage sawteeth 20 of the modular panel flange.

Downwardly directed U-shaped arm 104 of the male locking engagement member includes a generally horizontal portion 120 and a vertical portion 122. Arm 104 and base back surface 106 define a downwardly directed cavity 124 which will engage the upstanding flange of the second panel of modular panel unit 142 (FIG. 4B).

As in the case female locking engagement member 30, horizontal portion 120 may be stepped downwardly, as shown, to produce a slot 126 having an upwardly directed lip 128 for receiving engagement hook 74 of retention clip 34 and armoring the panel flange to achieve a metal-to-metal engagement. Other alternative structural arrangements for engagement between the retention clip and the locking engagement member may, of course, be used. Also, as can be readily understood from FIG. 3A, retention clip 34 may be rotated 180 degrees to engage slot 126 and lip 128 of the male locking engagement member rather than step 62 and upwardly directed lip 64 of the female portion, depending on construction requirements and the desire of the installer erecting the modular glazing panel units in place. Of course, as noted earlier, in less preferred embodiments other locking configurations could be used and, indeed, only one of the male and female locking engagement members may be provided with the slot and lip for accommodating the retention clip. In all cases, the resulting metal-to-metal interconnection represents a significant advance over prior systems, providing greatly enhanced resistance to wind load and other advantages as discussed earlier.

Guide member 82 includes a spine 83 that projects generally perpendicularly relative to surface 106 of base 100 and in this embodiment extends from portion 120 of downwardly directed U-shaped aim 104. Member 82 has a nub 130 adjacent its distal end 132 which projects downwardly from its bottom surface 134 to cooperate with nub 85 on portion 56 of the female locking engagement member during the interconnection of the male and female locking engagement members as will be explained below. Nub 130 has front and back inclined surfaces 136 and 138 which facilitate the interlocking process and help keep the corresponding locking engagement members together as installation of the panel units proceeds.

An end flange 140 is located at the distal end of spine 83 of guide member 82. Flange 140 has a generally flat outer surface 142 and an optional hook portion 145 which is dimensioned to rest below horizontal portion 44 of the female locking engagement member when the male and female locking engagement members are interconnected as in FIG. 3B to help limit water entering the inner gutter from reaching gutter seal 90 and to limit upward movement due to loading on the guide member. Finally, spine 82 and end flange 140 are dimensioned to ensure that when the male and female locking engagement members are interlocked as in FIG. 3B, flat outer surface 141 will abut (and preferably compress) resilient insulating strip 84 in cavity 80 of the female locking engagement member.

Turning now to FIGS. 4A and 4B (which correspond to FIGS. 3A and 3B), female and male locking engagement members 30 and 32 are shown with modular glazing panel units 10 locked into respective upwardly and downwardly directed cavities 48, 60, 106, and 124 by the engagement between sawteeth 20 of the panel units and sawteeth 50 of the locking engagement members. This forms modular panel units 142 and 144. Such units may be assembled either on-site in a convenient ground level area or off-site and transported to the work site. Once at the worksite the panel units will be erected into sloped glazing, skylights, roofs, walls or other architectural structures.

The modular panels in panel units 142 and 144 also include optional resilient areas in the form of, e.g., protruding open bubble areas 146 at the lateral edges of the panels. These open bubble areas substantially increase the resilience of the panel edges so that they can deform when the corresponding lateral edges of the panels move in and out due to lateral panel expansion and contraction. The adjacent resilient panel areas cooperate with the male and female locking engagement members which also accommodate lateral movement. Thus, unlike prior art systems where the lateral panel expansion cause the panels to bow, the present panels remain flat. At the same time, these resilient edges close the gap between adjacent panels to help in limiting or preventing air, water and sound infiltration. Other gap sealing approaches can of course be used.

Referring to FIGS. 4A and 4B, the installation method of the invention may proceed as follows:

A. First, examplary 40 foot panel units 142 and 144 of FIG. 4A are assembled, transported to the work site if necessary, and then preferably oriented and pre-positioned conveniently to the location where they will be installed. It should be noted that panel unit 142 has a male locking engagement member at its opposite (hidden) lateral edge whereas panel unit 144 has a female locking engagement member at its opposite (hidden) lateral edge.

B. Next, unit 142 may be positioned on the appropriate purlin or rafter (not shown) and locked in place by a series of retention clips 34 spaced, e.g., about 4 to 10 feet apart with their engagement hooks engaging slots 62 and lips 64 of the female locking engagement member which in turn engages armor the 40 foot modular panel flanges. As noted earlier, attachment to the male locking engagement members may proceed from the other side by rotating the retention clip 180 degrees and first installing panel unit 144 by way of attachment slots 126 and lips 128 of the male locking engagement members. Also, for shorter spans the assembly may not require intermediate support making it possible to dispense with the use of retention clips.

C. Assuming that unit 142 is already affixed in position, modular glazing panel unit assembly 144 is then juxtaposed against unit 142 with its lateral edge 160 opposite the lateral edge 162 of the already affixed panel unit 142. In this orientation, guide member 82 will be located opposite inner cavity 80 of female locking engagement member 30.

D. Then, panel unit 144 will be pivoted about adjoining lateral edges 160 and 162 as inclined surface 136 of nub 130 on the guide member first engages inclined surface 87 on nub 85 of the female member and the nub 130 rides over numb 85 causing an audible "click" and providing the installer with a tactile indication that the male and female locking engagement members are properly interconnected with flat outer surface 141 of flange 140 abutting and preferably compressing resilient insulating strip 84 as depicted in FIG. 3B and the lower lateral panel edges 164 and 166 abutting as well. When the locking engagement members are interconnected in this way abutting inclined surfaces 88 and 138 will maintain units 142 and 144 together so that the installer can move to the next lateral adjacent position to begin installing the next panel unit.

E. In an alternative installation approach, panel unit 144 may be vertically aligned and slid horizontally into place until the locking engagement members are interconnected.

F. This process continues until the outer panel units are reached. The outer panels are affixed by conventional perimeter framing. Thus a series of units held in place by retention clips as illustrated in FIG. 4B and confined by outer panels or separate conventional structural members to ensure that the entire installation will withstand substantial loads even up to hurricane levels while providing outstanding resistance to air, water and sound infiltration as well as outstanding energy conservation characteristics and the ability to accommodate lateral expansion and contraction of the modular panels to a degree not heretofore thought possible.

Figure 5B:
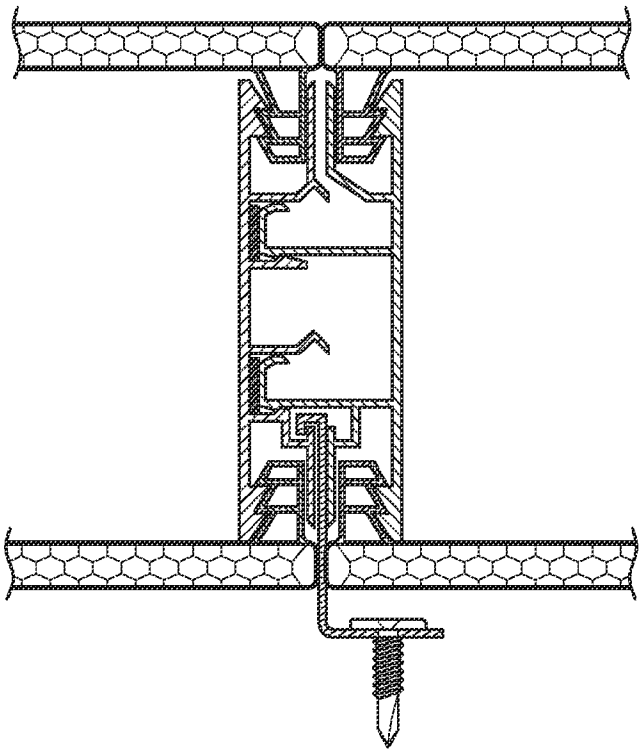
FIGS. 5A and 5B correspond generally to FIGS. 4A and 4B except that alternative male and female locking engagement members are depicted in panel units with an enlarged airspace between the top and bottom panels.
Figure 5A:
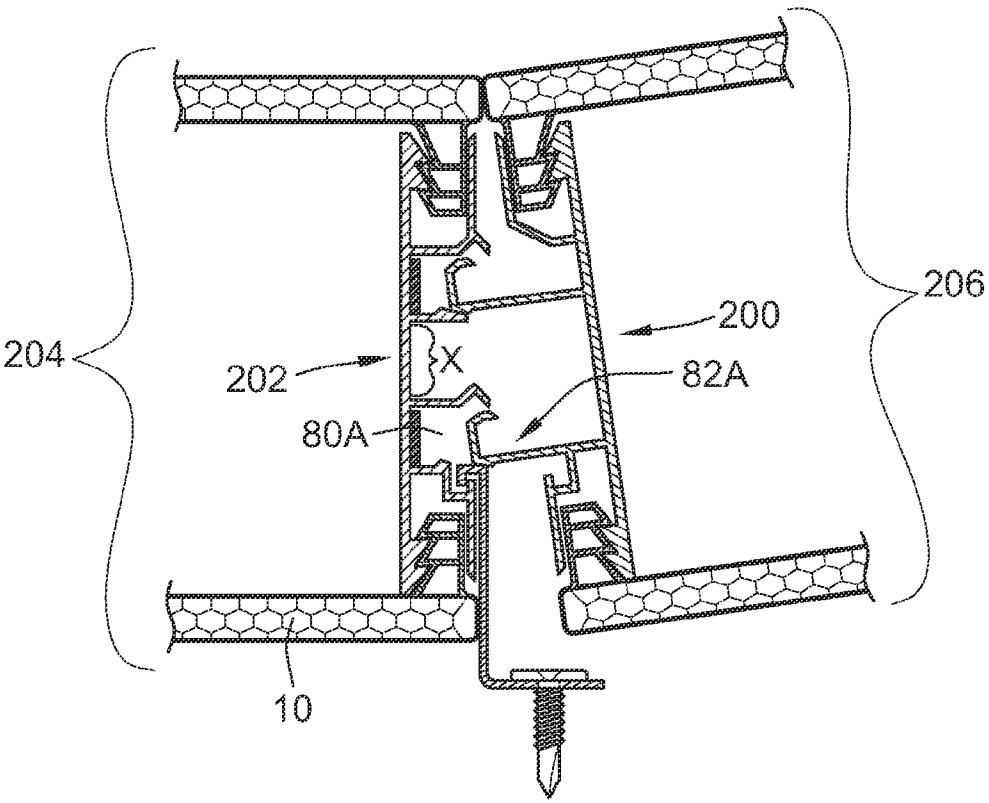

FIGS. 5A and 5B illustrate an alternative embodiment of the invention in which female and male locking engagement members 202 are used to assemble panel units 204 and 206. As is apparent in these figures, locking engagement members 200 and 202 are taller than locking engagement members 30 and 32 thus establishing a taller and larger airspace between the module panel pairs. For example, the airspace of the units of FIGS. 4A and 4B may be, for example, about 2.5 inches in height whereas the airspace of the units of FIGS. 5A and 5B may be, for example, about 4.0 inches in height. This height difference is achieved by incorporating a second inner cavity 80A and corresponding second guide member 82A spaced a distance "x" from the first inner cavity. Smaller and larger inner cavities and guide members as well as more than two pairs of these features may be used. These additional features further enhance the installation process by, e.g., improving the signaling and interlocking operation of the male and female locking engagement members. The greater height airspace panel units are also stiffer, further enhancing their ability to withstand loads and the added lower inner gutter 81A (which may optionally be fitted with a gasket strip) further limits water and sound infiltration.

Figure 6:
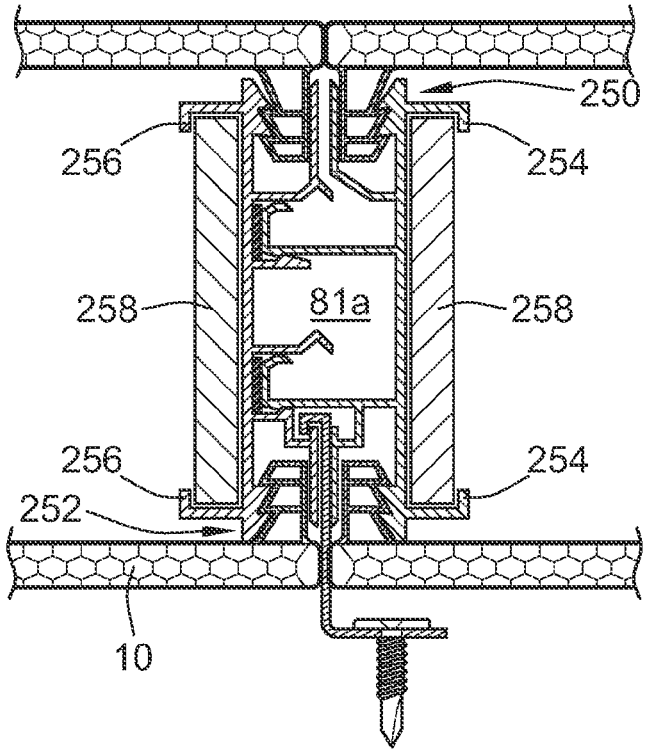
FIG. 6 corresponds to FIG. 5B except that yet another interlocking male and female locking engagement member design is used in which the locking engagement members are provided with side stiffener bars.

FIG. 6 illustrates yet another alternative embodiment of the invention in which male and female locking engagement members 250 and 252 are used. These locking engagement members generally correspond to locking engagement members 200 and 202 of FIGS. 5A and 5B except that the locking engagement members are provided with outer brackets 254 and 256 for holding side stiffener bars. The side stiffener bars run along the locking engagement member improving the section moment of inertia of the locking engagement members, thereby enhancing the load capacity characteristics of the overall panel unit and its ability to handle longer spans. The side stiffener bars are preferably made of solid aluminum or steel although they may be hollow if desired.

Figure 7:
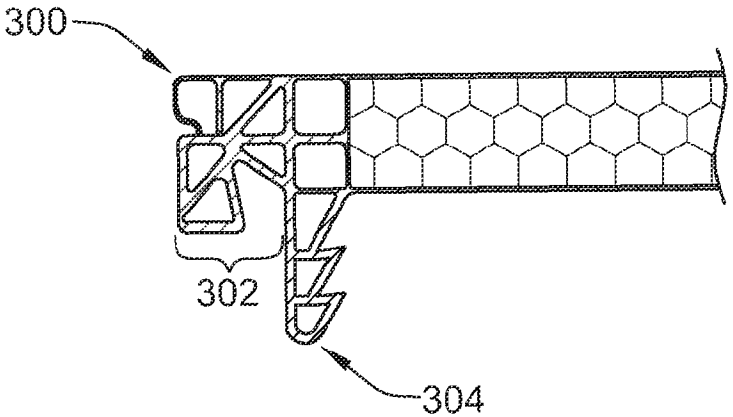
FIG. 7 is a partial exploded perspective view of another modular panel design which may be used in the practice of the invention.
Figure 8B:
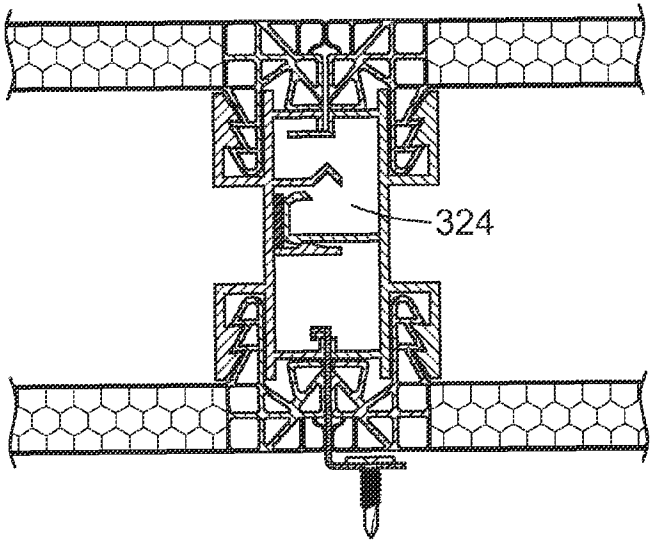
FIGS. 8A and 8B are, respectively, partial elevation views of panel units using still other locking engagement member designs with the modular panels of FIG. 7, before and after interconnection of the panel units.
Figure 8A:
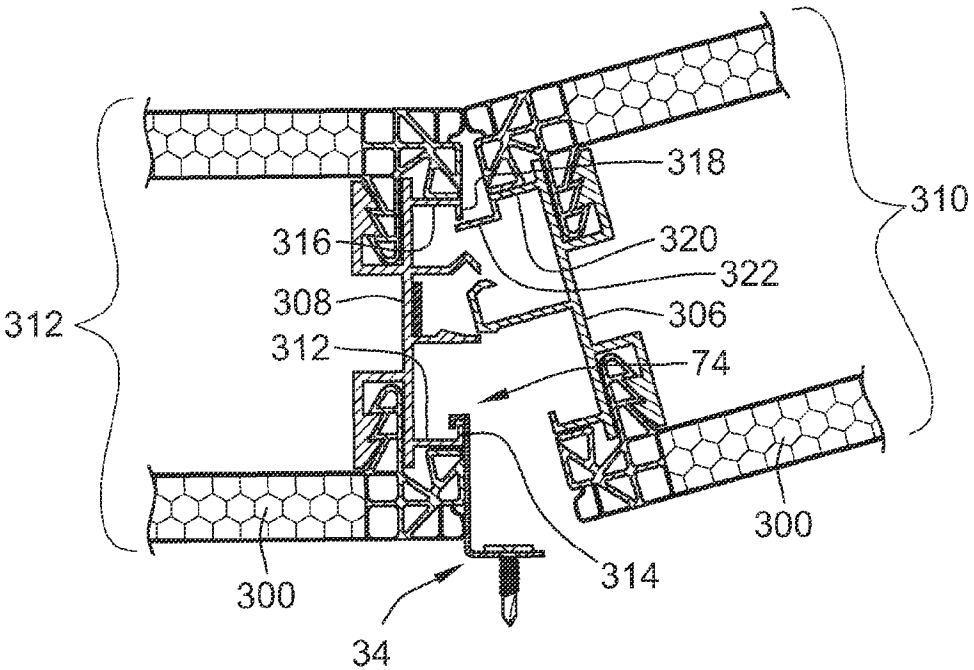

FIG. 7 depicts a modular panel 300 having a double connector design comprising an outer connector 302 and an inner standing seam flange 304. Such panels are shown installed in male and female locking engagement members 306 and 308 in FIGS. 8A and 8B forming panel units 310 and 312. The locking engagement members use the pivoting or sliding interlocking motion of the earlier-described locking engagement members and form an inner gutter 324 in the same way using like structural features. Upstanding lip 314 onto which a hook 74 of a retention clip 34 is fit again achieves the metal-to-metal engagement discussed earlier. Additionally, the female locking engagement member includes a ledge 316 on which outer panel connector 302 rests to provide enhanced load bearing capability and a downwardly directed shoulder 318. Male locking engagement member 306 has a corresponding first shelf 320 for supporting the outer connector 302 of the adjacent panel 300 of panel unit 310. Finally, shelf 320 jogs downwardly to provide a second lower shelf 322 which engages downwardly directed shoulder 318 of the female locking engagement member when the panel units are interconnected as depicted in FIG. 8B. The engagement of shoulder 318 and shelf 322 is the first line of defense against the infiltration of water into the inner gutter 324 in the interconnected units and also provides enhanced load bearing capabilities (FIG. 8B).

Figure 9:
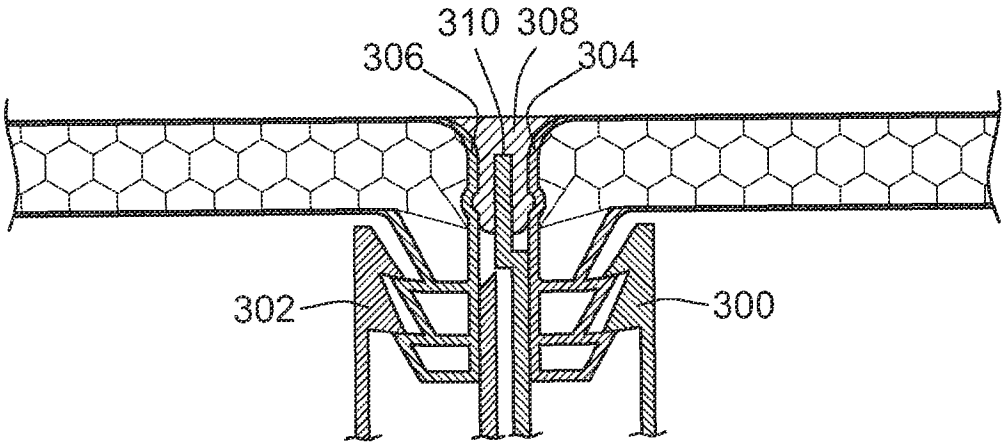
FIG. 9 is a partial elevation view of the tops of adjacent panel units assembled in accordance with the present invention in which a gasket is disposed in the gap between the adjacent top panels and held in place by a pin affixed to one of the locking engagement members of the units.

Finally, FIG. 9 is a partial view of the top modular panels of two panel units interconnected using male and female locking engagement members 300 and 302. This Figure is included to illustrate an alternative embodiment in which the lateral edges 304 and 306 of the panels are spaced from each other.

In this arrangement, a resilient gasket 308 is fitted into the gap between the panel edges and held in place by a pin 310 affixed to locking engagement member 300.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What I claim is:

1. A modular upstanding seam flange panel unit comprising:

interlocking metal male and female locking engagement members each having upwardly and downwardly disposed cavities, wherein the male locking engagement member includes a guide member having a first nub and the female locking engagement member includes a walled cavity structured for receiving the guide member, the walled cavity having a corresponding second oppositely directed nub on a wall of the cavity positioned to engage the first nub on the guide member of the male locking engagement member as the male and female locking engagement members are moved into interlocking position;

opposed elongated top and bottom upstanding seam flange panels with corresponding elongated upwardly and downwardly directed seam flanges disposed at opposite lateral edges of the panels captured in the upwardly and downwardly directed cavities of the interlocking metal male and female locking engagement members and an airspace disposed between the panels, and the modular panels having skins with substantially lower ultimate tensile strength than the ultimate tensile strength of the interlocking metal male and female locking engagement members.

2. The panel unit of claim 1 in which the panel flanges include at least one sawtooth and the upwardly and downwardly disposed cavities of the interlocking metal male and female locking engagement members have at least one sawtooth engaging the at least one sawtooth of each of the modular panel flanges.

3. The panel unit of claim 1 including at least two panel units in which when interlocked the metal male and female locking engagement members of two adjoining laterally disposed panel units include an internal gutter for collecting any water that infiltrates past the opposed lateral edges of the top modular panels of adjoining modular panel units.

4. The panel unit of claim 3 in which the bottom of the internal gutter is defined by a guide member that projects from the male locking engagement member in cooperation with a walled cavity in the female locking engagement member that receives the guide member.

5. The panel unit of claim 4 in which the walled cavity in the female locking engagement member includes a resilient member disposed to sealingly engage the guide member of the male locking engagement member when the male and female locking engagement members are interlocked.

6. The panel unit of claim 1 in which the upstanding seam flanges are spaced inwardly from the lateral edges of the modular panels.

7. The panel unit of claim 1 including infill in the airspace between the panels.

8. The panel unit of claim 7 in which the infill is chosen from the group consisting of translucent insulation and metal screening.

9. An architectural structure for passing sunlight into an interior region of a building having supporting structure while limiting the infiltration of water, air and sound comprising:

interlocking metal male and female locking engagement members each having upwardly and downwardly disposed cavities, wherein the male locking engagement member includes a guide member having a first nub and the female locking engagement member includes a walled cavity structured for receiving the guide member, the walled cavity having a corresponding second oppositely directed nub on a wall of the cavity positioned to engage the first nub on the guide member of the male locking engagement member as the male and female locking engagement members are moved into interlocking position;

at least two transparent or translucent modular panel units each having opposed elongated top and bottom modular panels, the panels of the panel units having corresponding elongated upwardly and downwardly directed seam flanges disposed at opposite lateral edges of the panels captured in the upwardly and downwardly directed cavities of the interlocking metal male and female locking engagement members and an airspace disposed between the panels, and the panel units having corresponding locking engagement members interlocked with opposite locking engagement members of adjacent panel units.

10. The architectural structure of claim 9 in which the panel skins have substantially lower ultimate tensile strength than the ultimate tensile strength of the interlocking metal male and female locking engagement members.

11. The architectural structure of claim 9 in which the panel flanges include at least one sawtooth and the upwardly and downwardly disposed cavities of the interlocking metal male and female locking engagement members have at least one sawtooth engaging the at least one sawtooth of each of the flanges.

12. The architectural structure of claim 9 in which when interlocked the metal male and female locking engagement members of adjoining panel units include an internal gutter for collecting any water that infiltrates past the opposed lateral edges of the top modular panels of adjoining modular panels.

13. The architectural structure of claim 12 in which the bottom of the internal gutter is defined by a guide member that projects from the male locking engagement member in cooperation with a walled cavity in the female locking engagement member that receives the guide member.

14. The architectural structure of claim 13 in which the walled cavity in the female locking engagement member includes a resilient member disposed to sealingly engage the guide member resilient member of the male and female locking engagement member when interlocked.

15. The architectural structure of claim 9 in which the modular panels include resilient areas along their lateral edges adapted to follow lateral expansion and contraction of the modular panels helping control air, water and sound infiltration when the panel units are interlocked and to avoid buckling of the panels as a result of lateral panel expansion.

16. The architectural structure of claim 9 in which at least one of the corresponding locking engagement members is affixed to a supporting member by metal retaining clips.

17. The architectural structure of claim 15 including metal retaining clips engaging the locking engagement member of one of the units, the retaining clips being affixed to the supporting structure of the building.

18. The architectural structure of claim 17 in which at least one of the male and female locking engagement members includes a slot and the retaining clips have hooks for engaging the male or female locking engagement members slots.

19. A modular upstanding seam flange panel unit comprising:

interlocking male and female locking engagement members each having upwardly and downwardly disposed cavities, wherein the male locking engagement member includes a guide member having a first nub and the female locking engagement member includes a walled cavity structured for receiving the guide member, the walled cavity having a corresponding second oppositely directed nub on a wall of the cavity positioned to engage the first nub on the guide member of the male locking engagement member as the male and female locking engagement members are moved into interlocking position;

opposed elongated top and bottom upstanding seam flange panels with corresponding elongated upwardly and downwardly directed seam flanges disposed at opposite lateral edges of the panels captured in the upwardly and downwardly directed cavities of the interlocking metal male and female locking engagement members and an airspace disposed between the panels, and the modular panels having skins with substantially lower ultimate tensile strength than the ultimate tensile strength of the interlocking metal male and female locking engagement members.

20. A method of erecting an architectural structure for passing sunlight into an interior region of a building having supporting structure while limiting the infiltration of water, air and sound comprising:

assembling at least two transparent or translucent modular upstanding seam flange panel units having opposed elongated top and bottom upstanding seam flange panels with corresponding elongated upwardly and downwardly directed flanges and an airspace disposed between the panels, the seam flanges being disposed at or near opposite lateral edges of the panels, with interlocking metal male and female locking engagement members each having upwardly and downwardly disposed cavities attached respectively to the corresponding upwardly and downwardly directed flanges at the opposite lateral edges of the modular panels, the modular panels having skins with substantially lower ultimate tensile strength than the ultimate tensile strength of the interlocking metal male and female locking engagement members; and interconnecting male and female locking engagement members at opposite lateral edges of the modular panel units, wherein the male locking engagement member includes a guide member having a first nub and the female locking engagement member includes a walled cavity structured for receiving the guide member, the walled cavity having a corresponding second oppositely directed nub on a wall of the cavity positioned to engage the first nub on the guide member of the male locking engagement member as the male and female locking engagement members are moved into interlocking position.

21. The method of claim 20 including affixing at least one of the corresponding male and female locking engagement members to a supporting structure.

22. The method of claim 20 in which infill is placed in the airspace during the assembly of the panel units.

23. The method of claim 22 in which the infill is chosen from the group consisting of translucent insulation and metal screening.

* * * * *